US010217309B2

(12) United States Patent
Blythin et al.

(10) Patent No.: US 10,217,309 B2
(45) Date of Patent: Feb. 26, 2019

(54) MONEY ITEM DISPENSING

(71) Applicant: CRANE PAYMENT INNOVATIONS LIMITED, Lancashire (GB)

(72) Inventors: Robert James Blythin, Manchester (GB); Andrew Barson, Cheshire (GB); Wesley Perry, Cheshire (GB)

(73) Assignee: Crane Payment Innovations Limited, Lancashire (GB)

( * ) Notice: Subject to any disclaimer, the term of this patent is extended or adjusted under 35 U.S.C. 154(b) by 0 days.

(21) Appl. No.: 15/462,723

(22) Filed: Mar. 17, 2017

(65) Prior Publication Data

US 2017/0193728 A1 Jul. 6, 2017

Related U.S. Application Data

(63) Continuation of application No. 14/891,664, filed as application No. PCT/GB2014/051480 on May 15, 2014, now Pat. No. 9,697,666.

(30) Foreign Application Priority Data

May 15, 2013 (GB) ..... 1308761.4

(51) Int. Cl.
*G07D 11/00* (2006.01)
*G07D 9/00* (2006.01)
(Continued)

(52) U.S. Cl.
CPC ..... *G07D 9/008* (2013.01); *G07D 1/02* (2013.01); *G07D 1/06* (2013.01); *G07D 3/16* (2013.01);
(Continued)

(58) Field of Classification Search
CPC .. G07D 3/14; G07D 3/16; G07D 9/00; G07D 9/04; G07D 9/008; G07D 11/0051; G07D 11/0069; G07D 11/0054; G07D 11/0066; G07D 11/0072; G07D 11/0075; G07F 19/209
See application file for complete search history.

(56) References Cited

U.S. PATENT DOCUMENTS 3,680,566 A 8/1972 Tanaka et al.
2006/0019591 A1* 1/2006 Abe ..... G07D 3/02 453/18
(Continued)

FOREIGN PATENT DOCUMENTS

CN 101796552 A 8/2010
EP 1020819 A1 7/2000
(Continued)

OTHER PUBLICATIONS

International Search Report and Written Opinion dated Sep. 4, 2014 in connection with International Patent Application No. PCT/GB2014/051480; 10 pages.
(Continued)

*Primary Examiner* — Mark J Beauchaine

(57) ABSTRACT

A method and system for auditing money items within a secure housing, the monety items being collected from a multi-denomination money item storage unit and validated while being transported by a conveyor that deposits them back into the multi-denomination storage unit after they have been identified. The same process is done with the money items present in the at least one hopper.

20 Claims, 9 Drawing Sheets

(51) Int. Cl.

| | |
|---|---|
| ***G07D 3/16*** | (2006.01) |
| ***G07D 9/04*** | (2006.01) |
| ***G07D 1/02*** | (2006.01) |
| ***G07D 1/06*** | (2006.01) |

(52) U.S. Cl.
CPC ..... *G07D 9/04* (2013.01); *G07D 11/0054* (2013.01); *G07D 11/0072* (2013.01); *G07D 11/0075* (2013.01)

(56) References Cited

U.S. PATENT DOCUMENTS

| | | | | |
|---|---|---|---|---|
| 2010/0062701 | A1* | 3/2010 | Ohno | G07D 9/00 453/57 |
| 2010/0210200 | A1 | 8/2010 | Bell et al. | |
| 2012/0122385 | A1 | 5/2012 | Watson et al. | |
| 2013/0205723 | A1 | 8/2013 | Blake et al. | |
| 2014/0290539 | A1 | 10/2014 | Tagashira et al. | |
| 2016/0049035 | A1* | 2/2016 | Doi | G06Q 20/042 221/9 |

FOREIGN PATENT DOCUMENTS

| | | | |
|---|---|---|---|
| GB | 2416061 | A | 1/2006 |
| JP | 2008084164 | A | 4/2008 |
| WO | WO 2011/158205 | A1 | 12/2011 |

OTHER PUBLICATIONS

Office Action dated May 29, 2018 in connection with Chinese Patent Application No. 201480026635.7, (11 pages).
Office Action dated Jul. 3, 2018 in connection with Japanese Patent Application No. 2016-513437, (8 pages).

* cited by examiner

MONEY ITEM DISPENSING

CROSS-REFERENCE TO RELATED APPLICATION(S)

The present application is a continuation of U.S. patent application No. 14/891,664 filed on Nov. 16, 215, which claims priority under 35 U.S.C. § 365 to International Patent Application No. PCT/GB2014/051480 filed May 15, 2014, entitles "MONEY ITEM DISPENSING", and, through International Patent Application No. PCT/GB2014/051480, to United Kingdom Patent Application No. 1308761.4 filed May 15, 2013, each of which are incorporated herein by reference into the present disclosure as if fully set forth herein.

FIELD

This specification relates to dispensing money items. Particularly, but not exclusively, the specification relates to dispensing money items from a multi-denomination money item storage unit in a money item dispensing system comprising one or more money item hoppers.

BACKGROUND

Money item dispensing systems, such as those used in monetary payout systems to dispense selected coins to retail customers, generally include a plurality of money item hoppers for dispensing money items. The hoppers are often single denomination hoppers, meaning that each hopper contains a plurality of money items which all have the same denomination. When the system is required to dispense a particular value of money items, the system causes money items to be released from one or more appropriate single denomination hoppers in order to make up the value of the required payout.

A typical coin-based currency contains a relatively large number of different denominations of coins and therefore, in order to be able to quickly pay out each denomination of coin, a monetary dispensing system may contain a correspondingly large number of single denomination hoppers. Typically, between four and eight hoppers will be required to fit within the relatively small space envelope which has been specified for the system. Generally, each hopper has the same fixed size and so the solution is not ideal in terms of coin volumes in the system.

An alternative solution, which requires fewer hoppers, is to provide single denomination hoppers for only a subset of coin denominations. The remaining denominations of coins are generally not available for dispensing and therefore it is sometimes required to make payouts using a larger number of coins than would be required if the full coin set were available.

SUMMARY

According to a first aspect of the specification, there is provided a method of supplying money items from a multiple denomination money item storage region in a money item dispensing system, comprising creating a mixed magazine of different denominations of money items by collecting money items from the multiple denomination money item storage region; receiving a request for money items; determining whether the request can be fulfilled using money items in the magazine; supplying selected money items in the magazine to fulfil the request.

The mixed magazine may be created on a money item conveyor by releasing a plurality of different denominations of money items from the storage region onto the money item conveyor and storing the money items on the conveyor.

The money items may be released onto the conveyor at random.

The method may comprise detecting the denomination of the money items in the magazine in a sensing region of the conveyor path between a money item receiving region of the conveyor path and a money item exit region of the conveyor path.

The money item magazine may comprise a plurality of known-denomination money items on the conveyor between the sensing region of the conveyor path and exit region of the conveyor path.

The conveyor may be configured to collect more money items from the storage region to refresh the magazine in the event that the request cannot be fulfilled using the original magazine.

The mixed magazine may comprise more than three money items of known denomination.

The mixed magazine may comprise more than five money items of known denomination.

The mixed magazine may comprise between three and twenty money items of known denomination.

The mixed magazine may comprise between five and twenty money items of known denomination.

The money item storage region may be a mixed denomination cash box.

The method may comprise supplying money items from the magazine for a payout from the system.

The method may comprise supplying money items from the magazine to fill one or more money item hoppers in the dispensing system.

The hoppers may be dumb hoppers.

Supplying the selected money items in the magazine to fulfil the request may comprise dispensing the money items into a money item transfer chamber; and conveying the money items from the money item transfer chamber to fulfil the payout.

Conveying the money items from the money item transfer chamber to fulfil the payout may comprise conveying the money items on a transfer conveyor to a money item exit of the transfer conveyor.

The method may comprise actively retaining a plurality of one or more selected denominations of money items in the multiple denomination money item storage region.

According to a second aspect of the specification, there is provided a method of securely auditing money items within a secure housing of a money item dispensing system comprising at least one money item hopper and at least one multi-denomination money item storage unit, comprising collecting money items from the multi-denomination storage unit using a conveyor; determining and recording the denomination of each collected money item on the conveyor; conveying the money items back into the storage unit; collecting the money items from each money item hopper using a conveyor; determining and recording the denomination of each collected money item on the conveyor; and conveying the money items back to the money item hoppers.

According to a third aspect of the specification, there is provided a method of re-assigning a denomination of a money item hopper in a money item dispensing system, comprising emptying the contents of the money item hopper into a mixed money item storage chamber of the system; collecting a mixed magazine of money items from the mixed money item storage chamber; identifying money items in the mixed magazine which are of a particular denomination; and dispensing the identified money items into the emptied money item hopper.

Collecting the mixed magazine of money items may comprise collecting money items at random from the mixed money item storage.

The method may comprise initially actively retaining a plurality of money items of one or more selected denominations in the mixed money item storage chamber so that they are available for the mixed magazine.

The method may comprise initially retaining a plurality of money items of the particular denomination in the mixed money item storage chamber so that they are available for the mixed magazine.

The particular denomination may be the lowest denomination of money items used in the system.

According to a fourth aspect of the specification, there is provided a money item dispensing system configured to perform the method.

According to a fifth aspect of the specification, there is provided a money item dispensing system comprising means for performing the method.

According to a sixth aspect of the specification, there is provided a money item dispensing system comprising a mixed denomination money item storage chamber; a money item recycling conveyor configured to convey a magazine of mixed denomination money items from the storage chamber; a money item transfer chamber configured to receive money items from the money item recycling conveyor; and a money item transfer conveyor configured to convey money items from the money item transfer chamber to be dispensed to other regions of the system.

According to a seventh aspect of the specification, there is provided a money item dispensing system comprising a mixed denomination money item storage chamber for storing a plurality of money items of different denominations; a money item recycling conveyor configured to convey a magazine of mixed denomination money items from the storage chamber; and a money item sensing region configured to determine a denomination of each of the money items in the magazine so that, upon receiving a request for money items, the system determines whether the request can be fulfilled using the plurality of denominated money items in the magazine and supplies selected money items in the magazine to fulfil the request.

The system may also comprise a money item transfer chamber configured to receive money items from the money item recycling conveyor; and a money item transfer conveyor configured to convey money items from the money item transfer chamber to be dispensed to other regions of the system.

The transfer conveyor may be configured to dispense money items into one or more money item hoppers of the system.

The transfer conveyor may be configured to dispense money items into a money item payout region of the system.

The system may be configured to determine the denominations of money items on the recycling conveyor so as to determine the denominations of money items in the magazine.

The system may comprise a housing. A maximum height of the housing may be 285.5 mm or less in order to fit within standard industry size envelopes.

The height of the housing may be less than or equal to 284.5 mm+/−1.0 mm and therefore may have a maximum height of 285.5 mm. This may be to ensure that the height of the housing, and all of the elements of the system within it, is such that the system fits within a standard size envelope required by the industry.

The system may be configured to perform the methods and/or may comprise means for performing the methods.

For the purposes of example only, embodiments of the invention are described below with reference to the accompanying figures in which:

DETAILED DESCRIPTION

Figure 1:
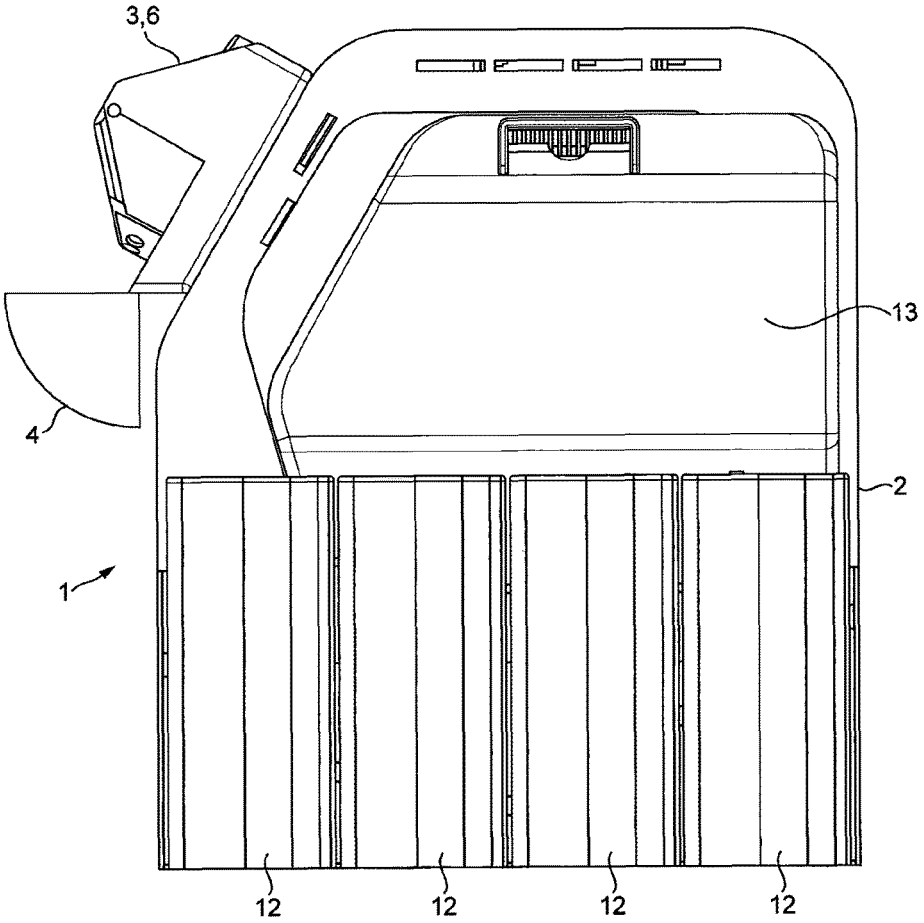
FIG. 1 is a schematic illustration of a money item dispensing system comprising a secure exterior housing.

A money item dispensing system 1 is illustrated schematically in FIG. 1. The system 1 is configured to dispense money items, such as coins or tokens, from one region of the system 1 to another.

Figure 2:
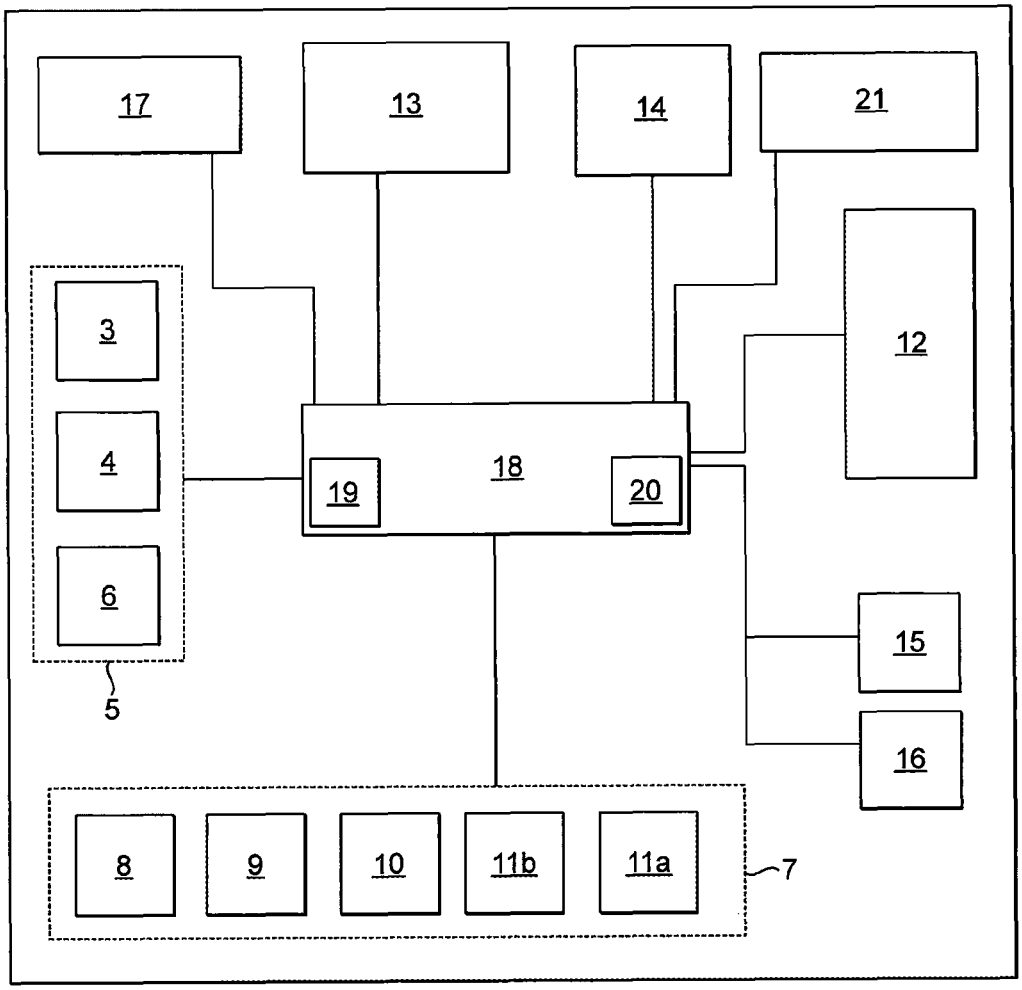
FIG. 2 is a schematic diagram of a money item dispensing system.

As shown in FIGS. 1 and 2, the system 1 comprises a secure housing 2 in which the money items are stored. The housing 2 provides a first line of protection for the money items against unauthorised personnel by preventing access to the internal regions of the system 1. At the exterior of the housing 2 is provided a money item inlet 3, through which the dispensing system 1 can receive money items, and a money item outlet 4, through which the system 1 can dispense money items for collection by users.

Money items which are received through the money item inlet 3 are initially directed into a debris separation region, a money item singulating region and/or a money item validating region, which together with the inlet 3 are comprised in a money item receiving section 5 of the system 1. These regions may, for example, be combined or otherwise contained in a bulk entry pay-in module 6 into which the money items are directed by a money item chute or other type of channel connected to the inlet 3. However, it will be understood that one or more of the tasks performed by the bulk entry pay-in module 6 could alternatively be carried out separately by different modules of the system 1, such as a money item singulator, a money item validator and a debris remover in the receiving section 5.

Items which are determined as not valid money items in the receiving section 5 do not progress further into the dispensing system 1 and are instead returned to the user, for example via the money item outlet 4.

Items which are determined as valid money items in the receiving section 5 are directed into the dispensing system 1. For example, referring to FIG. 2, the money items may be directed from the receiving section 5 into a money item transfer unit 7 which is configured to selectively transfer the money items to other elements of the system 1.

Figure 3:
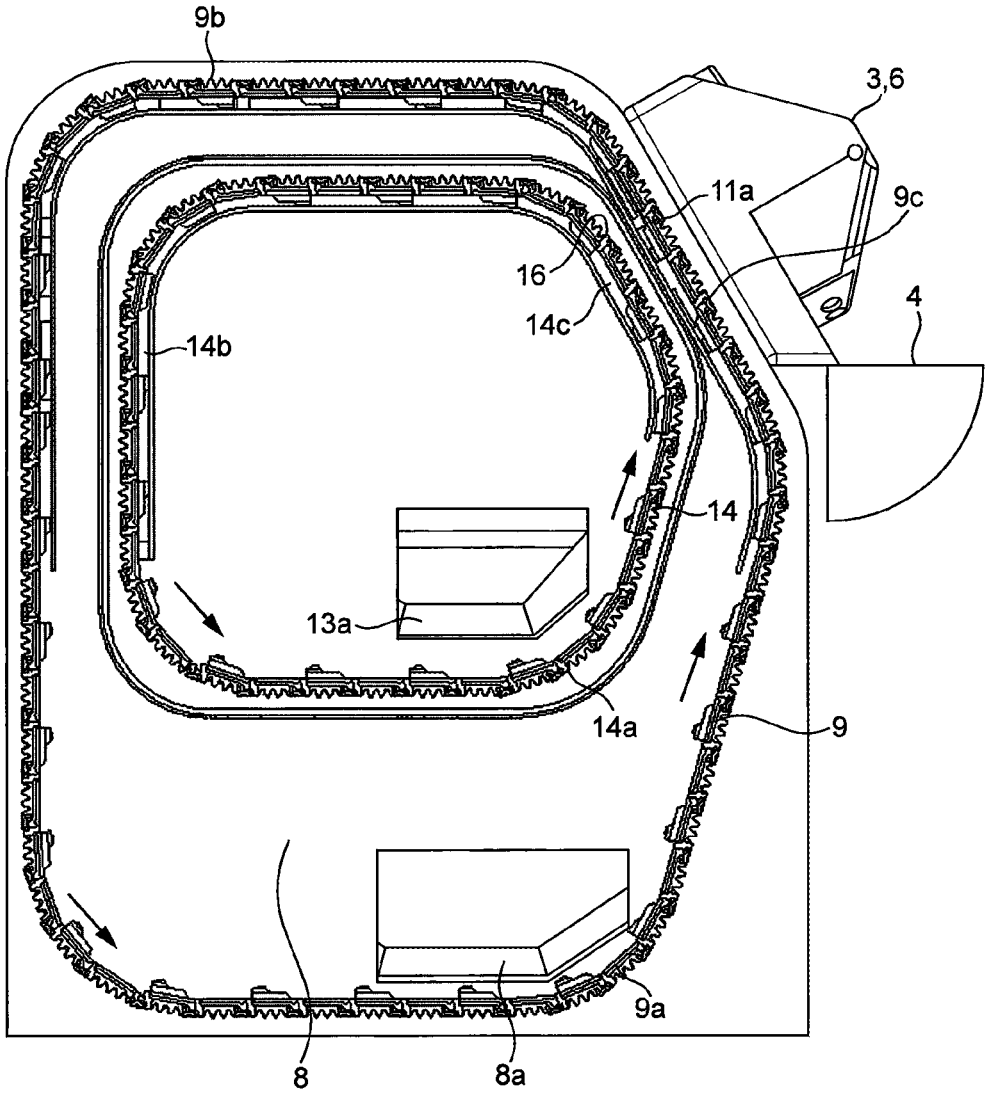
FIG. 3 is a schematic illustration of a money item dispensing system in which a money item conveyor recycles money items from a multiple denomination money item cash box to create a mixed magazine of money items.

Referring to FIG. 3, the money item transfer unit 7 comprises a temporary money item storage chamber 8 and a transfer conveyor 9 to convey money items from the chamber 8 to the other elements of the system 1. The temporary storage chamber 8, which is referred to below as a transfer chamber 8, comprises a money item inlet [not shown], through which money items are received from the receiving section 5, and a money item outlet 8*a* through which money items in the transfer chamber 8 are released in order to be dispensed to other regions of the system 1.

The money item outlet 8*a* of the transfer chamber 8 is configured to feed money items in the chamber 8 onto a receiving region 9*a* of the money item transfer conveyor 9, which in turn is configured to singulate the money items and individually convey the money items along a conveyance path towards exits 10 in an exit region 9*b* of the conveyor 9. The money items may be fed onto the conveyor 9 under gravity. For example, referring to FIG. 4, the height of the outlet 8*a* of the transfer chamber 8 may be such that it is arranged to selectively allow money items to slide onto the money item receiving region 9*a* of the conveyor 9.

As illustrated by the example shown in FIG. 3, the transfer conveyor 9 may comprise a series of connected money item conveying members which together form an endless loop conveyor 9. Movement of the conveyor 9 is caused by engagement with one or more controllable drive units [not shown], which cause the conveyor 9 to rotate along its looped path. For example, teeth on a circumferential surface of the conveyor 9 may engage with a drive wheel of the drive unit so that movement of the drive wheel causes corresponding movement of the conveyor 9.

Figure 5:
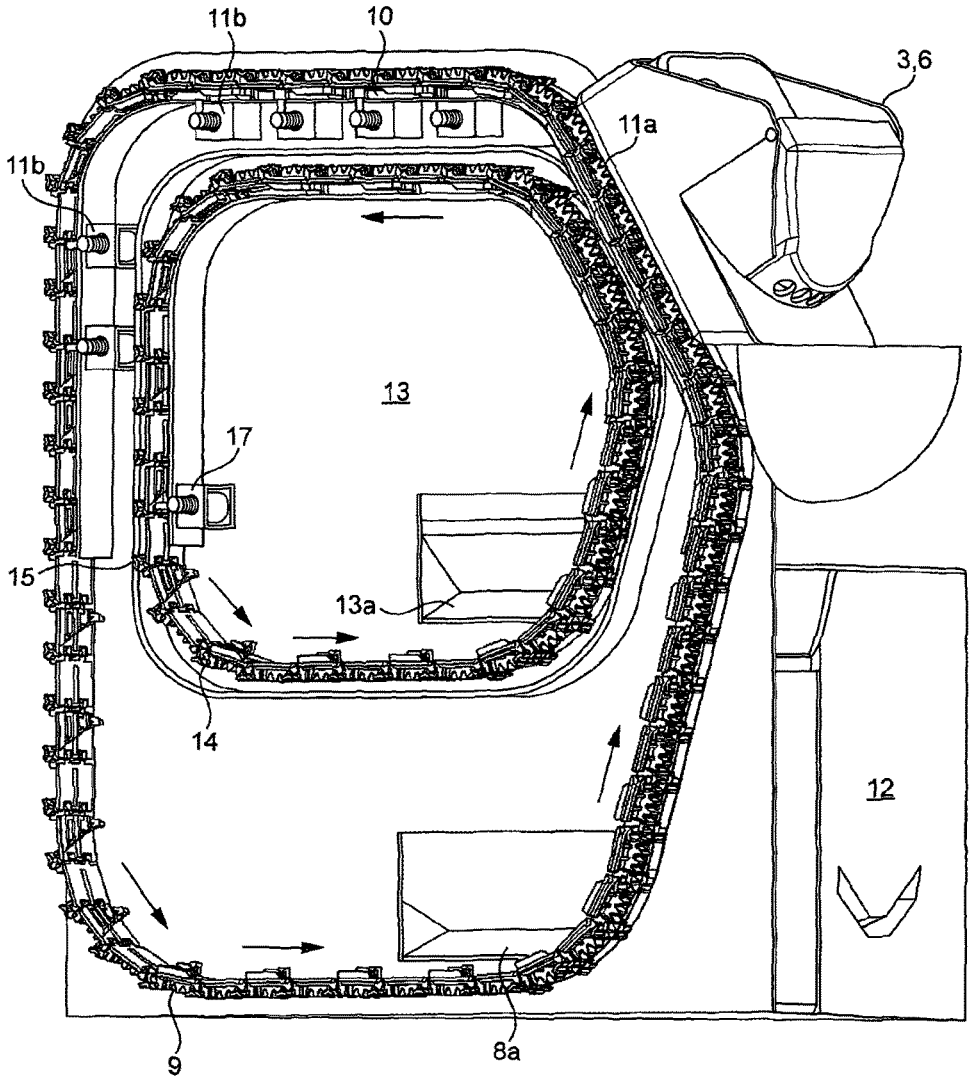
FIG. 5 is a schematic illustration of the paths of a money item transfer conveyor, from which money items are dispensed to other regions of a money item dispensing system, and a money item recycling conveyor configured to recycle mixed magazines of money items from a mixed denomination cash box and selectively feed the money items towards the money item transfer conveyor.

At the conveyor exits 10, the money items on the transfer conveyor 9 are selectively dispensed into another region of the system 1. For example, as shown in figure 5, at each conveyor exit 10 may be located a money item sorter 11*b* which is configured to selectively route individual money items off the conveyor 9 and into the exit 10. The sorters 11*b* may operate in association with one or more money item denominators 11*a* which are configured to determine the denomination of each money item on the conveyor 9. The denominator(s) 11*a* are located in a money item sensing region 9*c* of the conveyor path between the receiving region 9*a* and the exit region 9*b* so that the denomination of each money item on the transfer conveyor 9 is known to the system 1 before the money item reaches the exits 10. In this way, the sorters 11*b* are able to sort specific denominations of money item into the exits 10 based on their positions on the conveyor 9, and thus sort the money items into appropriate regions of the system 1.

Figure 4:
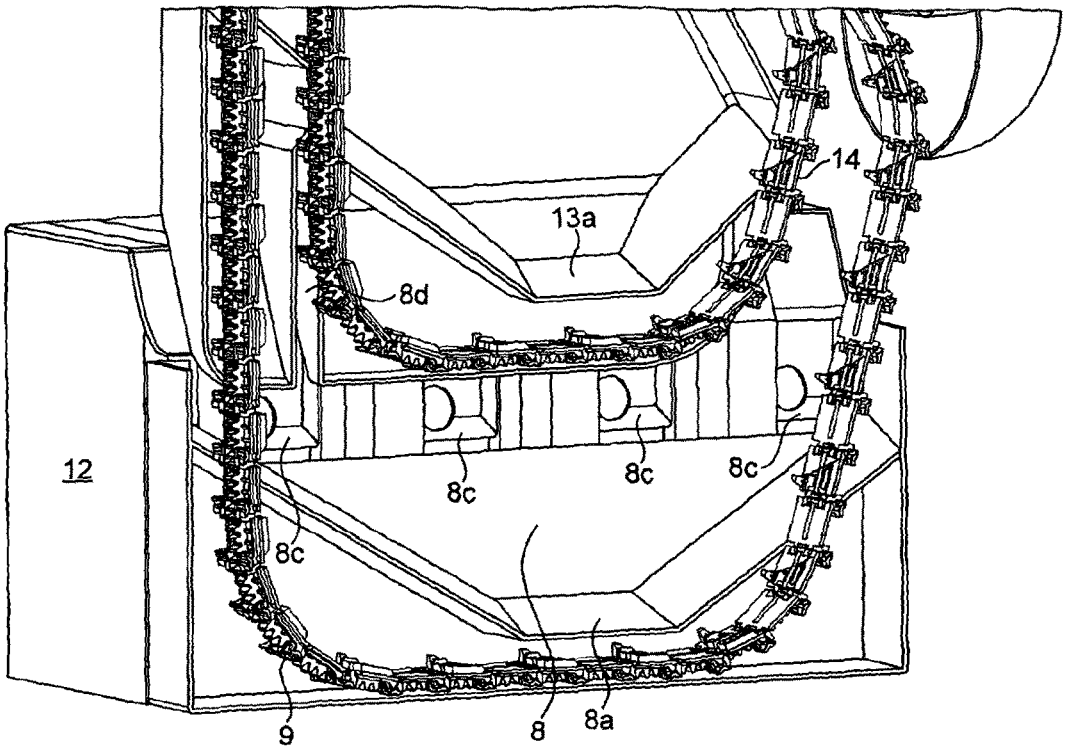
FIG. 4 is a schematic illustration of a money item recycling conveyor for recycling money items from a mixed denomination cash box to a money item transfer chamber from which money items are dispensed to other regions of a money item dispensing system.
Figure 6:
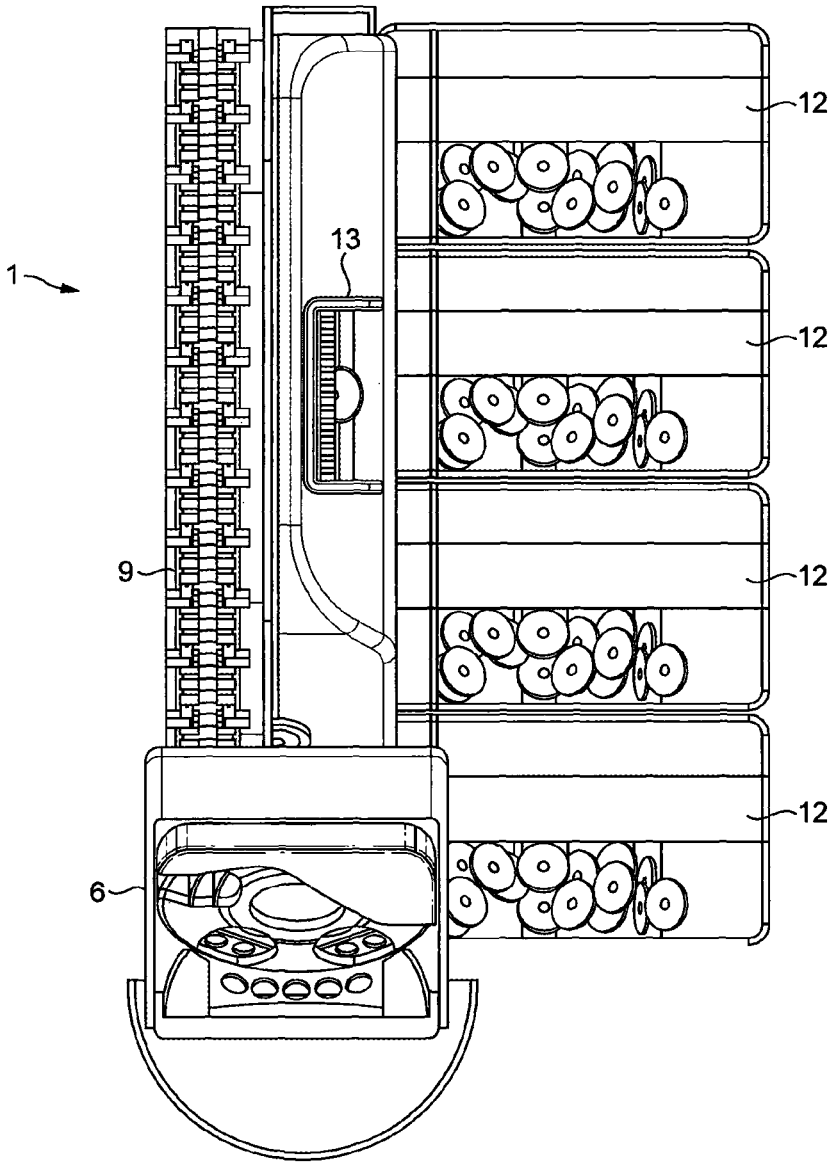
FIG. 6 is schematic plan view of a money item dispensing system 1 comprising a plurality of single denomination money item hoppers and a money item recycling conveyor for recycling mixed magazines of money items from a mixed denomination cash box.

Referring to FIGS. 3, 4 and 6, in addition to the elements already described above, the dispensing system 1 comprises one or more money item hoppers 12 and at least one multiple denomination money item storage chamber 13, which is known in the industry as a cash box 13. Each of the hoppers 12 and the cash box 13 is associated with one of the money item exits 10 referred to above, so that money items on the conveyor 9 can be selectively sorted into the hoppers 12 or the multiple denomination cash box 13 via the appropriate conveyor exit 10. In this way, money items can be selectively dispensed from the transfer chamber 8 to other regions of the system 1. These regions are not limited to the hoppers 12 and cash box 13. For example, money items on the transfer conveyor 9 may also be selectively dispensed into the money item outlet 4 for collection by users at the exterior of the system 1. This will be evident from the detailed examples given further below.

Each money item hopper 12 is a single denomination hopper 12, meaning that it contains a plurality of money items which all have the same denomination. This allows the hoppers 12 to be used for rapid money item dispensing operations, since there is no requirement for any hunting operations to be carried out in the hoppers 12.

As shown in FIGS. 3 and 4, each hopper 12 is configured to supply money items for payout by selectively feeding its money items, for example under gravity, into the money item transfer chamber 8. The money items are fed from the hoppers 12 into the transfer chamber 8 via transfer chamber inlets 8*c*, with one inlet 8*c* being provided for each money item hopper 12. A gate [not shown] in each inlet 8*c* may be configured to selectively open and close in order to allow the system 1 to control the flow of money items from each of the hoppers 12 into the chamber 8 and thereby obtain the desired value of money items in the chamber 8. The system 1 is configured to re-stock the money item hoppers 12 by dispensing appropriate denominations of money items from the transfer conveyor 9 into the appropriate conveyor exits 10. Such items may comprise money items which have recently been received through the money item inlet 3, or may comprise money items which have been recycled from the mixed denomination money item cash box 13, as described below.

The multi-denomination money item cash box 13 is not limited to a particular denomination of money items. Instead, the cash box 13 operates as storage for all money items which are not stored in the hoppers 12. The result is that the cash box 13 contains a plurality of different denominations of money items. It will be appreciated that one of the functions of the cash box 13 is to operate as overflow storage to store money items which cannot be accommodated in the hoppers 12. This scenario might occur, for example, if the relevant single denomination hopper 12 for a particular money item on the transfer conveyor 9 is full, or if the system 1 does not comprise an appropriate single denomination hopper 12 for the money item.

Money items which are dispensed into the multiple denomination cash box 13 through the exits 10 of the transfer conveyor 9 are made available for later transfer to other regions of the system 1 by a cash box recycling conveyor 14. For example, referring back to FIG. 4, the cash box recycling conveyor 14 may be configured to convey money items from the cash box 13 back towards an inlet 8*d* of the money item transfer chamber 8 so that the money items can be used for payouts or for filling the single denomination hoppers 12. In general, the recycling conveyor 14 allows money items which would otherwise have been locked in the cash box 13 to be redistributed to other regions of the system 1 and thus allows the system 1 to maximise its available set of money items to operate for lengthy periods within the need for manual redistributions or maintenance.

The recycling conveyor 14 has a similar structure and operates in a similar manner to the transfer conveyor 9 previously described. In particular, as shown in FIG. 4, money items are fed onto a receiving region 14*a* of the conveyor 14 from a money item outlet 13*a* of the cash box 13 and conveyed in a looped path toward one or more money item exits 15 in an exit region 14*b* of the conveyor 14. The outlet 13*a* of the cash box 13 may be gravity fed, as illustrated in FIG. 4, in a similar manner to the outlet 8*a* of the transfer chamber 8.

One or more money item denominators 16 in a sensing region 14*c* of the conveyor 14 is located between the receiving region 14*a* and the exit region 14*b*. The denominator(s) 16 operate to determine the denomination of each money item on the conveyor 14 before the money item reaches the exits 15. This allows money item sorters 17, located at each exit 15 of the conveyor 14, to function in a similar manner to the sorters 11*b* described previously to cause individual money items on the recycling conveyor 14 to be directed into particular, selected, exits 15, and thus into desired regions of the system 1, based on their positions on the conveyor 14.

The feed of money items onto the recycling conveyor 14 may be random, in that there is no active pre-selection of particular denominations of money items to be fed onto the conveyor 14. Instead, the multiple denomination nature of the cash box 13 causes a correspondingly mixed feed of money items to be deposited onto the receiving region 14*a* of the conveyor 14.

As illustrated in FIG. 2, the recycling conveyor 14 is configured to accommodate a plurality of money items simultaneously in between the sensing region 14*c* and the exit region 14*b*. The denominations of these money items are known to the system 1, since each has been denominated by the denominator(s) 16. The money items on the conveyor 14 therefore constitute a known magazine of money items, which is likely to contain a plurality of different denominations. The magazine acts as a stored memory of money items which are available for rapid dispensing at all times. The total number of money items in the mixed magazine may be three or more, such as four or more. For example, the number of money items in the magazine may be between five and 20. It will be appreciated that the size of the magazine could be changed by making changes to the length of the conveyor 14 or its design.

In addition to the money items accommodated between the sensing region 14*c* and the exit region 14*b*, the known magazine of money items may comprise money items in other regions of the recycling conveyor 14. In particular, the known magazine of money items may comprise all money items on the recycling conveyor 14 that have passed the sensing region 14*c* of the conveyor path at least once. This is because, once a money item has passed the sensing region 14*c* at least once, its denomination and position on the conveyor 14 are known. It is therefore possible for the number of money items in the known magazine to be equal to the number of money items that can be accommodated on the conveyor 14 as a whole. An increase in the number of money items in the known magazine is advantageous because it means that more money items, and denominations of money items, are available for rapid dispensing from the recycling conveyor 14 when required.

It will be appreciated that the location of the sensing region 14*c* illustrated in FIG. 3 is an example and that the sensing region 14*c* could additionally or alternatively be located in another region of the conveyor path. For example, an alternative or additional money item discriminator 14*c* may be provided in the region of the conveyor path that immediately precedes the location of the money item exit region 14*b*. Such a discriminator 14*c* may, optionally, be used to carry out a final check of the value of a money item that has been selected for dispensing from the known magazine. The value of the money item may be checked by the discriminator immediately before the money item is exited from the conveyor 14 in order to ensure that the money item 14 that has been selected for exit is still present on the conveyor 14 in its previously detected location.

The mixed magazine of money items on the recycling conveyor 14 is available to the system 1 at all times and can be used to achieve various different effects. In particular, the recycled money item magazine may be used to facilitate money item payout operations to the money item outlet 4, money item redistribution operations within the system 1, secure system auditing operations and hopper denomination changes, as will be described below.

As is evident from the examples illustrated in FIG. 3, the transfer conveyor 9 and the recycling conveyor 14 are of different lengths. The shorter of the conveyors 14, which in the example of FIG. 3 is the recycling conveyor 14, is located entirely within the internal region of the longer conveyor 9, which in the example of FIG. 3 is the transfer conveyor 9, so that the looped paths of the conveyors 9, 14 are in the same plane. The alignment of the shorter conveyor 14 in the plane of the longer conveyor 9, as clearly shown in FIG. 6, allows the recycling conveyor 14 to be accommodated in the system 1 without the conveyors 9, 14 occupying any more volume than would be occupied by the transfer conveyor 9 alone. This is advantageous in view of the small space envelopes into which money item dispensing systems 1 are often required to fit.

Referring to FIG. 2, the operation of the dispensing system 1, including that of the conveyors 9, 14 and other elements described above, may be controlled by an electronic controller 18. The controller 18 comprises an electronic processor 19, such as a microprocessor 19, and a computer readable storage medium 20 which stores computer readable instructions in a computer program. The computer readable storage medium 20 may comprise, for example, one or more read-only memories (ROMs), random access memories (RAMs), EPROMs, EEPROMs, Flash memories, magnetic or optical cards or application specific integrated circuits (ASICs). Additionally or alternatively, the computer readable storage medium 20 may comprise any type of storage disk, such as one or more floppy disks, optical disks, CD-ROMs and/or magnetic-optical disks, or any other type of media suitable for storing electronic instructions which can be executed by the processor 19. The computer readable storage medium(s) 20 is coupled to the processor 19 and other elements of the controller architecture 18 via a computer system bus. The processor 19 is configured to implement the instructions under the control of the program to operate the system 1. For example, the controller 18 may be communicatively coupled to a power supply 21 of each of the elements of the system 2 so that the controller 18 can cause movement of the conveyor(s) 9, 14 and operation of the other elements of the system 1 as required.

For the avoidance of doubt, the controller 18 may include a single processor 19 or may comprise one or more architectures employing multiple processor designs 19 for increased computing capability.

Figure 7:
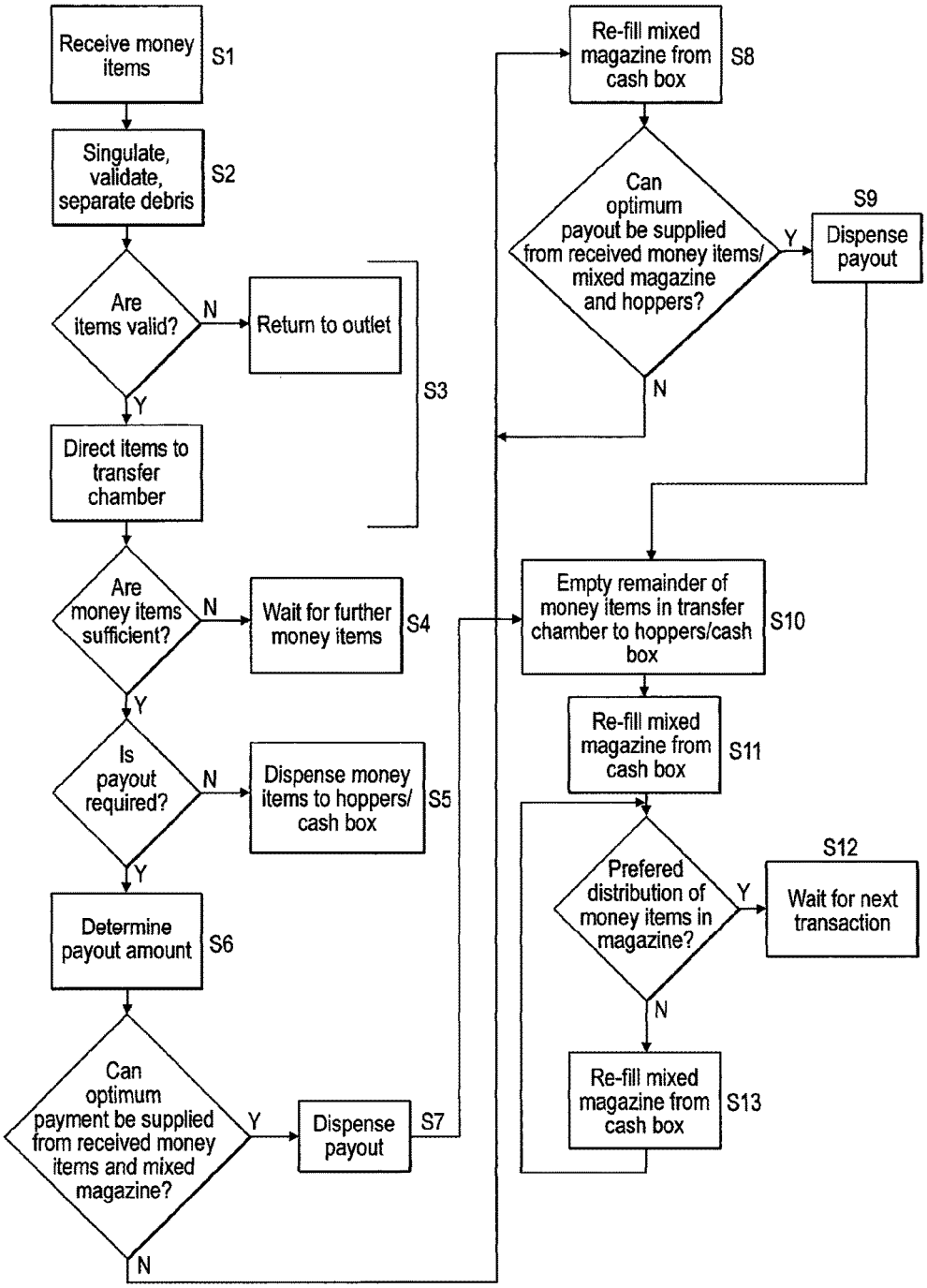
FIG. 7 is a flow diagram of an example method of operation of a money item dispensing system.

An example operation of the system 1 will now be described with respect to FIG. 7. The example is described with respect to a user transaction, in which the system 1 is configured to receive and accept monetary items as payment and to payout money items in the form of 'change' in order to refund overpayments. The operation is described in the context of a response to an initial money item payment into the system 1. It will be appreciated that this initial payment is not limited to money item coins and tokens, but could take any suitable form. For example, the initial payment may be in the form of inputted money item bills or a credit card payment. It will also be appreciated that money item payouts provided by the system 1 do not necessarily need to be in the form of refunds and that the system 1 could alternatively be used in a different context to provide the same or similar advantages to those discussed below. One example is to provide payouts in the form of cash-back requested by the user of the system 1, or in the form of betting-payouts.

In a first step S1, the system 1 receives one or more money items through the money item inlet 3. The money item inlet 3 may, for example, comprise a slot in the housing 2 through which money items can be inserted. The money items 3 are directed from the inlet 3 into the bulk entry pay-in module 6 which, in a second step S2 of the method, singulates and validates the money items. Any debris received through the inlet 3 is separated from the money items and directed into a debris container so that it does not progress further into the system 1.

In a third step S3, items which have been determined as valid money items are accepted and directed into the money item transfer chamber 8 of the transfer unit 7, whilst items which are not valid are returned to the user via the money item outlet 4. This may comprise a return cup, or similar, at the exterior of the housing 2.

In a fourth step S4, the system 1 determines whether the money items accepted into the transfer chamber 8 are sufficient to complete the transaction. If the value of the money items is insufficient, the system 1 is configured to hold the money items in the money item transfer chamber 8 and wait for further money items to be accepted into the system 1. If such items are not received within a predetermined period of time, or if the transaction is cancelled, the system 1 may be configured to return all money items to the user by releasing the money items in the transfer chamber 8 onto the conveyor 9 and activating the appropriate sorter 11*b* to dispense the money items back to the user via the money item outlet 4 at the exterior of the housing 2.

If the money items accepted into the transfer chamber 8 are sufficient to complete the transaction, the system 1 is configured in a fifth step S5 to determine whether there has been any overpayment. If there has been an overpayment, the money items may be temporarily retained in the transfer chamber 8 or on the transfer conveyor 9 whilst the system 1 determines how to deal with the overpayment in the sixth step S6. On the other hand, if there is no overpayment, the money items in the transfer chamber 8 may be immediately conveyed to the transfer conveyor exits 10 through which they are dispensed into the single denomination money item hoppers 12 or multiple denomination cash box 13 by the money item sorters 11*b*. This may comprise the money items being actively released through the money item outlet 8*a* onto the transfer conveyor 9. As described previously, each money item is dispensed individually in dependence of its denomination and the available storage options. For example, the system 1 may initially attempt to dispense each money item into a single denomination hopper 12 by identifying whether there is an appropriate single denomination hopper 12 which has capacity to accept the money item. If no such hopper 12 is available, for example because the appropriate hopper 12 is full or because no hopper 12 is allocated to accept the money item's denomination, the money item is dispensed into the mixed denomination cash box 13.

In the sixth step S6, the system 1 determines the value of the refund, or other type of payout, which is required to be dispensed to the user in order to allow the transaction to be completed.

In a seventh step S7, the system 1 determines whether the payout can be dispensed optimally using money items which are already present in the transfer chamber 8 and/or which are already present in the recycled money item magazine on the recycling conveyor 14. If the required refund can be dispensed using these money items, the system 1 causes the recycling conveyor 14 to rotate in order to cause recycled money items which have been identified for the payout to be dispensed into the transfer chamber 8 through the conveyor exit 15 and money item inlet 8*d* of the chamber 8. The money items are then released onto the transfer conveyor 9 and conveyed past the denominator(s) 11*a* to the appropriate money item exit 10, through which they are dispensed off the conveyor 9 and into the money item outlet 4 for collection by the user. The system 1 then progresses to the tenth step S10 described below.

If, on the other hand, the required payout cannot be supplied exclusively using money items present in the transfer chamber 8 and in the recycled money item magazine, the system 1 progresses to the eighth step S8.

In the eighth step S8, the system 1 is configured to rotate the recycling conveyor 14 for a predetermined period of time in order to partially or fully replace the existing money item magazine with a new, random selection of money items from the mixed denomination cash box 13. The previous magazine may be fully or partially dispensed back into the cash box 13 through an exit 15 of the conveyor 14.

In a ninth step S9, the system 1 determines whether money items which are already present in the transfer chamber 8 and/or the recycled magazine can be used in combination with selected money items from the single denomination hoppers 12 to make the required payout. If the system 1 determines that such a payout can be made, the money items which have been identified for the payout are dispensed from the recycling conveyor 14 and the money item hoppers 12, through the respective inlets 8*c*, 8*d*, into the transfer chamber 8 and onto the transfer conveyor 9. The transfer conveyor 9 is rotated past the denominator(s) 11*a* and the identified money items are ejected from the conveyor 9 to the money item outlet 4 through the relevant exit 10 for collection by the user. The system 1 then progresses to the tenth step S10 described below.

If, in the ninth step S9, it is determined that the required payout cannot be made optimally by combining money items in the hoppers 12 with those in the money item transfer chamber 8 and/or in the recycled money item magazine, the system 1 is configured to repeat the eighth step described above in order to refresh the money item magazine on the recycling conveyor 14. The system 1 then repeats the ninth step S9 in order to determine whether the required payout can be made optimally by combining money items in the hoppers 12 with those in the money item transfer chamber 8 and/or in the newly refreshed recycled money item magazine. In the event that, after a predetermined number of repetitions of the eighth and ninth steps S8, S9, or after a predetermined period of time or amount of rotation of the recycling conveyor 14, an optimal payout has not been identified, the system 1 may be configured to dispense money items exclusively from the hoppers 12 in order to supply the payout.

In a tenth step S10, which may be carried out concurrently with the payout steps described above, money items in the transfer chamber 8 which have not been identified as suitable for the money item payout are released from the transfer chamber 8 onto the transfer conveyor 9 and, from there, dispensed back into the single denomination hoppers 12 and/or multiple denomination cash box 13 in the manner previously described.

In an eleventh step S11, the system 1 determines whether the magazine on the recycling conveyor 14 is fully stocked and, if not, causes the recycling conveyor 14 to rotate past the cash box outlet 13*a* to collect more money items to refill the magazine. The magazine is thus ready for the next payout request and can be used without delay.

Optionally, in a twelfth step S12, the system 1 may determine whether the selection of money items in the recycled magazine is in accordance with preferred criteria and, if it is not, may in a thirteenth step S13 further rotate the recycling conveyor 14 in order to replace the magazine in the manner described above in relation to the eighth step S8. The criteria may, for example, be pre-stored in the computer readable medium 20 of the system 1 and may be related to whether there are desired numbers of different money item denominations available for payout from the magazine.

Figure 8:
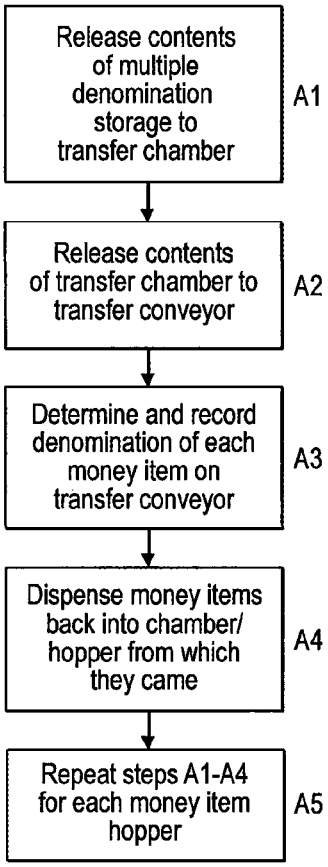
FIG. 8 is a flow diagram of another example method of operation of a money item dispensing system.

Another example operation of the system 1 will now be described with respect to FIG. 8. The example relates to a secure self-audit, in which the system 1 is configured to determine and record the contents of the system 1 in the computer readable memory medium 20 without the need for any money item to leave the secure enclosure provided by the housing 2.

In a first step A1 of the audit, the system 1 is configured to cause the entire contents of the multiple denomination cash box 13 to be progressively released onto the money item recycling conveyor 14 and, from there, dispensed into the money item transfer chamber 8 through the inlet 8*d* in the manner previously described. Before dispensing the contents of the cash box 13 into the transfer chamber 8, the system 1 ensures that the money item transfer chamber 8 is empty.

In a second step A2, the money items are released onto the transfer conveyor 9, where they are singulated and conveyed past the denominator(s) 11*a* in the sensing region 9*c* of the conveyor path. In a third step A3, the denomination of each money item on the conveyor 9 is determined and recorded in the computer readable storage medium 20 before the money items are, in a fourth step A4, dispensed back into the empty multiple denomination cash box 13 via the appropriate exit 10 of the conveyor 9.

In a fifth step A5, this process is repeated for each money item hopper 12. The contents of the hoppers 12 are emptied, one hopper 12 at a time, into the transfer chamber 8 and, from there, onto the transfer conveyor 9 where they are singulated and conveyed past the denominator(s) 11*a*. The denomination of each money item is determined and stored in the computer readable storage medium 20 before the money items are dispensed back into the hopper 12 from which they came via the appropriate exit 10 of the conveyor 9.

In this way, the dispensing system 1 is able to audit itself in a secure way. It is not necessary for the housing 2 to be opened or for any money item to be moved outside the housing 2. The system 1 thus avoids any requirement for the money items to be counted back into the system 1 by re-inserted them through the money item inlet 3.

Figure 9:
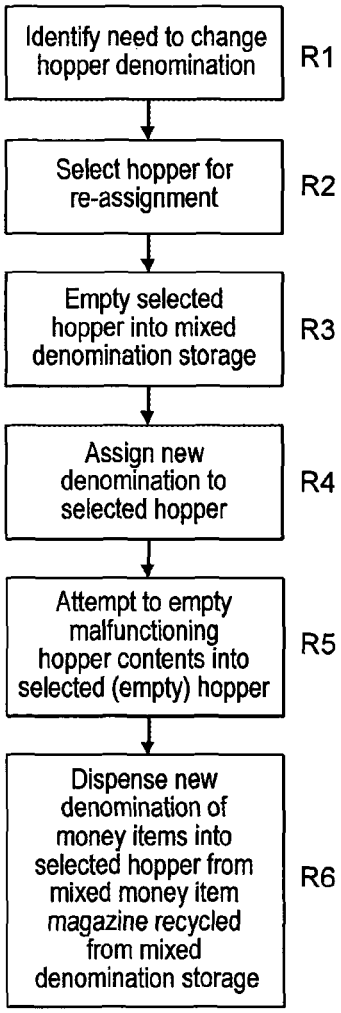
FIG. 9 is another flow diagram of an example method of operation of a money item dispensing system.

Another example operation of the system 1 will now be described with respect to FIG. 9. The example relates to re-assignment of a money item hopper 12 from one denomination of money items to another. Such a re-assignment may be desirable, for example, in the event that a money item hopper 12 holding a denomination of money items which is important to the system's ability to make payouts suffers a malfunction and is no longer able to operate. The example below is given in this context, although it will be appreciated that other scenarios are equally applicable.

In a first step R1 of the method, the system 1 identifies the need to change the denomination of money items stored within one or more of the single denomination hoppers 12. This identification may be made in response to the receipt of a request, for example from a user or administrator of the system 1, or in response to an automatic determination that the hopper 12 has malfunctioned or is otherwise not operating correctly.

In a second step R2, the system 1 selects a hopper 12 which is to be re-assigned. The hopper 12 may, for example, be selected on the basis that the denomination of money items which it is currently holding is not essential to the ongoing operation of the system 1, or that the denomination of money items currently held by the hopper 12 will be less important for future payouts than the denomination which was previously supplied from the malfunctioning hopper 12.

In a third step R3, the contents of the hopper 12 which is to be re-assigned are dispensed into the money item transfer chamber 8 through an inlet 8*c* of the chamber 8. From the transfer chamber 8, the money items are deposited onto the transfer conveyor 9 and dispensed into the multiple denomination cash box 13 so that they may be recycled for later use in the system 1.

In a fourth step R4, the system 1 re-assigns the newly emptied hopper 12 to a new denomination of money item.

In a fifth step R5, the system 1 attempts to dispense the contents of the malfunctioning hopper 12 into the money item transfer chamber 8 through an inlet 8*c* of the chamber 8. If this operation is successful, the money items are deposited from the transfer chamber 8 onto the transfer conveyor 9 and dispensed into the re-assigned, newly emptied hopper 12.

In a sixth step R6, the system 1 identifies money items in the recycled money item magazine which are of the denomination which has assigned to hopper emptied in the third step R3. Any such money items are dispensed into the re-assigned hopper 12 via the transfer chamber 8, transfer conveyor 9 and appropriate exit 10, as previously described. The system 1 may continue to rotate the recycling conveyor 14 in order to collect more money items of this denomination from the multiple denomination cash box 13 and dispense them into the re-assigned money item hopper 12. Items which appear in the magazine and which are not of the desired denomination are dispensed back into the cash box 13.

In order to account for a scenario in which the hopper 12 which is assigned to the lowest denomination money item malfunctions and the money items within it cannot be recovered, the system 1 may be configured to retain a predetermined number of the lowest denomination money items in the cash box 13 so that they can be recycled into the system 1 if needed. This prevents the system 1 from losing all access to money items of a particularly important denomination and thus from suffering a critical error which prevents its continued operation. Indeed, the system 1 may be configured to retain a predetermined number of any, or all, of the denominations of money item handled by the system 1 in the cash box 13. This ensures that such money items are always available for payouts and re-distribution within the system 1 if required.

It will be appreciated from the discussion above that the money item transfer chamber 8 is large enough to accommodate the maximum contents of any single one of the cash box 13 or hoppers 12.

The ability of the system 1 to recycle money items from the multiple denomination cash box 13 means that the cash box 13 does not need to be empty upon first running of the system 1. In contrast, the system 1 can be initialized with the cash box 13 already containing a mixed store of money items which can be used for payouts and/or to re-stock the money item hoppers 12. For example, at the time of system initialization the cash box 13 may be approximately 90% full. Furthermore, the system 1 is able to prevent the cash box 13 from becoming overly full and thus allows the system 1 to complete large numbers of transactions and to run for long periods of time without maintenance. The recycling cash box 13 and mixed money item magazine also allows the system 1 to operate with fewer money item hoppers 12, which frees up space in the system 1 for other components and/or allows the system 1 to fit within smaller space envelopes.

It will be appreciated that, although the system 1 has been described predominately with respect to single denomination hoppers 12, the system 1 could alternatively or additionally comprise dual denomination hoppers 12 which contain more than one denomination of money item. The hoppers 12 may be 'dumb' hoppers, in the sense that there is no active means of selecting money items to be dispensed from within the hoppers 12.

The features and operation of the multi-denomination money item cash box 13 described above, including the internal recycling conveyor 14, could be applied to a multi-denomination money item hopper so that a mixed magazine of denominated but randomly selected money items is available to be immediately dispensed from the hopper.

Other modifications to the system 1 described above could be made without departing from the scope of the claims.

The invention claimed is:

1. A method of securely auditing money items within a secure housing of a money item dispensing system, comprising:

collecting money items emptied from at least one money item storage region of the money item dispensing system using a conveyor;

determining and recording in a computer readable storage medium, using a money item denominator, a denomination of each collected money item on the conveyor in a money item sensing region of a path of the conveyor;

conveying the money items back into the at least one money item storage region.

2. The method of claim 1, wherein the at least one money item storage region comprises at least one money item hopper and the method comprises:

collecting money items emptied from the at least one money item hopper using the conveyor;

determining and recording the denomination of each collected money item emptied from the at least one money item hopper on the conveyor in the money item sensing region of the path of the conveyor;

conveying the money items back into the at least one money item hopper.

3. The method of claim 2, wherein the at least one money item storage region further comprises at least one multi-denomination money item storage apparatus and the method further comprises:

collecting money items emptied from the at least one multi-denomination money item storage apparatus using the conveyor;

determining and recording the denomination of each collected money item emptied from the at least one multi-denomination money item storage apparatus on the conveyor in the money item sensing region of the path of the conveyor;

conveying the money items back into the at least one multi-denomination money item storage apparatus.

4. The method of claim 1, wherein the at least one money item storage region comprises at least one multi-denomination money item storage apparatus and the method comprises:

collecting money items emptied from the at least one multi-denomination money item storage apparatus using the conveyor;

determining and recording the denomination of each collected money item emptied from the at least one multi-denomination money item storage apparatus on the conveyor in the money item sensing region of the path of the conveyor;

conveying the money items back into the at least one multi-denomination money item storage apparatus.

5. The method of claim 4, wherein the at least one money item storage region further comprises at least one money item hopper and the method further comprises:

collecting money items emptied from the at least one money item hopper using the conveyor;

determining and recording the denomination of each collected money item emptied from the at least one money item hopper on the conveyor in the money item sensing region of the path of the conveyor;

conveying the money items back into the at least one money item hopper.

6. The method of claim 1, wherein the money items emptied from the at least one money item storage region are collected by the conveyor at random.

7. The method of claim 1, wherein the money item sensing region of the path of the conveyor is between a money item receiving region of the path of the conveyor and a money item exit region of the path of the conveyor.

8. The method of claim 7, comprising creating a mixed magazine of money items comprising a plurality of known-denomination money items on the conveyor at least between the money item sensing region of the path of the conveyor and the exit region of the path of the conveyor.

9. The method of claim 8, wherein the mixed magazine of money items comprises one of:

more than three money items of known denomination;

more than five money items of known denomination;

between three and twenty money items of known denomination; and between five and twenty money items of known denomination.

10. The method of claim 1, wherein conveying the money items back into the at least one money item storage region comprises:

dispensing the money items into a money item transfer chamber; and conveying the money items from the money item transfer chamber to the at least one money item storage region.

11. The method of claim 10, wherein conveying the money items from the money item transfer chamber comprises conveying the money items on the conveyor to a money item exit of the conveyor.

12. A money item dispensing system comprising:

at least one money item storage region;

at least one money item conveyor configured to convey money items emptied from the at least one money item storage region;

at least one money item denominator in a money item sensing region of a path of the at least one money item conveyor;

at least one processor; and at least one tangible, non-transitory memory containing computer readable instructions which, when executed by the at least one processor, cause the money item dispensing system to:

collect money items emptied from the at least one money item storage region using the conveyor;

determine and record in a computer readable storage medium a denomination of each collected money item on the conveyor using the at least one money item denominator;

convey the money items back into the at least one money item storage region.

13. The money item dispensing system of claim 12, wherein the at least one money item storage region comprises at least one money item hopper; and wherein the computer readable instructions, when executed by the at least one processor, cause the money item dispensing system to:

collect money items emptied from the at least one money item hopper using the conveyor;

determine and record the denomination of each collected money item emptied from the at least one money item hopper on the conveyor in the money item sensing region of the path of the conveyor;

convey the money items back into the at least one money item hopper.

14. The money item dispensing system of claim 13, wherein the at least one money item storage region further comprises at least one multi-denomination money item storage apparatus; and wherein the computer readable instructions, when executed by the at least one processor, cause the money item dispensing system to:

collect money items emptied from the at least one multi-denomination money item storage apparatus using the conveyor;

determine and record the denomination of each collected money item emptied from the at least one multi-denomination money item storage apparatus on the conveyor in the money item sensing region of the path of the conveyor;

convey the money items back into the at least one multi-denomination money item storage apparatus.

15. The money item dispensing system of claim 12, wherein the at least one money item storage region comprises at least one multi-denomination money item storage apparatus; and wherein the computer readable instructions, when executed by the at least one processor, cause the money item dispensing system to:

collect money items emptied from the at least one multi-denomination money item storage apparatus using the conveyor;

determine and record the denomination of each collected money item emptied from the at least one multi-denomination money item storage apparatus on the conveyor in the money item sensing region of the path of the conveyor;

convey the money items back into the at least one multi-denomination money item storage apparatus.

16. The money item dispensing system of claim 15, wherein the at least one money item storage region further comprises at least one money item hopper; and wherein the computer readable instructions, when executed by the at least one processor, cause the money item dispensing system to:

collect money items emptied from the at least one money item hopper using the conveyor;

determine and record the denomination of each collected money item emptied from the at least one money item hopper on the conveyor in the money item sensing region of the path of the conveyor;

convey the money items back into the at least one money item hopper.

17. The money item dispensing system of claim 12, wherein the money items emptied from the at least one money item storage region are collected by the conveyor at random.

18. The money item dispensing system of claim 12, wherein the money item sensing region of the path of the conveyor is between a money item receiving region of the path of the conveyor and a money item exit region of the path of the conveyor.

19. The money item dispensing system of claim 18, wherein the computer readable instructions, when executed by the at least one processor, cause the money item dispensing system to create a mixed magazine of money items comprising a plurality of known-denomination money items on the conveyor at least between the money item sensing region of the path of the conveyor and the exit region of the path of the conveyor.

20. The money item dispensing system of claim 12, wherein the system comprises a money item transfer chamber; and wherein the computer readable instructions, when executed by the at least one processor, cause the money item dispensing system to convey the money items back into the at least one money item storage region by:

dispensing the money items into the money item transfer chamber; and conveying the money items from the money item transfer chamber to the at least one money item storage region.

* * * * *